US005478441A

United States Patent [19]

Hamilton

[11] Patent Number: 5,478,441

[45] Date of Patent: Dec. 26, 1995

[54] RECOVERY AND RE-USE OF RAW MATERIALS FROM PAPER MILL WASTE SLUDGE

[75] Inventor: Robert Hamilton, Stoneywood, United Kingdom

[73] Assignee: The Wiggins Teape Group Limited, England

[21] Appl. No.: 73,666

[22] Filed: Jun. 8, 1993

[30] Foreign Application Priority Data

Jun. 17, 1992 [GB] United Kingdom ..... 9212867

[51] Int. Cl.[6] ..... D21F 1/66

[52] U.S. Cl. ..... 162/189; 162/DIG. 9; 162/56; 210/928

[58] Field of Search ..... 162/189, DIG. 10, 162/4, 55–57; 210/928

[56] References Cited

U.S. PATENT DOCUMENTS

| | | | |
|---|---|---|---|
| 3,220,546 | 11/1965 | Gardner | 162/DIG. 9 |
| 3,235,444 | 2/1966 | Kruger | 162/DIG. 9 |
| 3,364,101 | 1/1968 | Eek | 162/189 |
| 3,576,710 | 4/1971 | Mader | 162/DIG. 9 |
| 3,769,116 | 10/1973 | Champeau | 156/62.8 |
| 3,876,497 | 4/1975 | Hoffman | 162/189 |
| 3,895,998 | 7/1975 | Haywood et al. | 162/DIG. 9 |
| 3,943,034 | 3/1976 | Wallén | 162/232 |
| 4,030,968 | 6/1977 | Goel et al. | 162/16 |
| 4,303,019 | 12/1981 | Hoataja et al. | 162/DIG. 9 |
| 4,481,072 | 11/1984 | Grudinin et al. | 162/16 |
| 4,560,527 | 12/1985 | Harke et al. | 162/DIG. 9 |
| 4,921,573 | 5/1990 | Beier et al. | 162/4 |
| 4,983,258 | 1/1991 | Maxhem | 162/DIG. 9 |
| 5,002,633 | 3/1991 | Maxham | 162/4 |
| 5,176,793 | 1/1993 | Kurtz | 162/4 |

FOREIGN PATENT DOCUMENTS

| | | | |
|---|---|---|---|
| 2007736 | 7/1990 | Canada . | |
| 2007735 | 7/1990 | Canada . | |
| 0032364B | 7/1981 | European Pat. Off. . | |
| 0259639B | 1/1988 | European Pat. Off. . | |
| 0442183A | 8/1991 | European Pat. Off. . | |
| 2224591 | 10/1974 | France . | |
| 2348526 | 4/1975 | Germany . | |
| 4034054 | 4/1992 | Germany . | |
| 465242 | 9/1971 | Japan | 162/189 |
| 445890 | 4/1936 | United Kingdom | 162/190 |
| 138744 | 3/1975 | United Kingdom . | |
| 1482002 | 8/1977 | United Kingdom . | |
| 2066304 | 7/1991 | United Kingdom . | |
| 1535001 | 8/1991 | United Kingdom . | |

OTHER PUBLICATIONS

E. Linck et al., "Advanced Technology for Secondary Fibre Treatment in Tissue Systems", reprinted for Sulzer–Escher Wyss GmbH, Germany.

J. Kleuser et al., "Deinking Systems for Tissue, Writing and Printing Papers", reprinted for Sulzer–Escher Wyss GmbH, Germany.

*Primary Examiner*—Brenda Adele Lamb
*Attorney, Agent, or Firm*—Burns, Doane, Swecker & Mathis

[57] ABSTRACT

In a process for the recovery and re-use of raw materials from paper mill waste sludge, the sludge is subjected to a preliminary cleaning treatment at a relatively low consistency, thickened to a consistency of 10 to 30%, heated to at least 100° C. and then passed through a disperser in the thickened heated state before being passed to a papermachine for re-use. Papermaking fibre from at least one other source is mixed with the sludge before and/or after treatment as just described, so that the final paper product typically contains up to 30% of raw materials recovered from sludge. The action of the disperser is to break up dirt and other debris, and as a result, the recovered raw materials can be re-used in the manufacture of high quality fine papers.

20 Claims, 3 Drawing Sheets

RECOVERY AND RE-USE OF RAW MATERIALS FROM PAPER MILL WASTE SLUDGE

This invention relates to the recovery and re-use of raw materials from paper mill waste sludge.

Paper is conventionally made by draining a low consistency dispersion of cellulose fibre pulp, fillers and additives through a paper machine "wire" (essentially an endless mesh or sieve). A certain amount of solid material passes through the wire with the suspending water, and so is not retained in the wet paper web formed on the wire. The drained suspension water and entrained solid material is known as "white water", and is re-used as far as practicable. Complete recovery and re-use of water and papermaking raw materials is impossible, and a certain proportion is discharged as effluent. Waste also occurs when the type or grade of paper being produced alters, especially if this involves a colour change or the use of different additives or fillers.

Effluent from the papermachine(s) has to be treated before it can be discharged from the mill. This treatment normally involves passage through a clarifier, prior to which flocculants are added to promote sedimentation of solid material. A biological treatment with microorganisms is often also carried out in order to reduce the biological oxygen demand (BOD) of the liquid effluent before it is discharged.

The sediment which accumulates in the clarifier is a sludge composed of pulp fibres, fibre particles ("fines"), and fillers and pigments, together with miscellaneous debris such as grit, sand, plastic particles, general dirt and, particularly if waste paper has been used by the mill as a raw material, ink particles, accumulations of adhesive ("stickies") and foreign bodies, e.g. pieces of plastic material or metal ("contraries"). Since the clarifier normally takes the form of a large open-air tank, it can accumulate organic environmental debris as well, for example leaves, branches, insects, etc.

Conventionally, the sludge is drawn off from the clarifier at about 2.5% consistency and is then dewatered to a consistency of around 20–25%, for example by means of rotary vacuum filters. It is then semi-solid and is collected for transport and disposal, for example in landfill sites. This is expensive, since a medium to large paper mill can generate thousands of tonnes of sludge for disposal each year. Landfill and associated transport costs can be expected to increase as landfill sites become scarce.

Attempts have been made to find economic uses for paper mill sludges which avoid the need for landfill or other disposal, and/or to recover re-usable raw materials from the sludges.

Some sludges can be burnt for steam and/or power generation, but the practicality of this depends on the nature, amount and variability of the sludge produced. For example, sludges with a high filler content, as might be produced in a paper mill specialising in fine paper production, may not be adequately combustible, and/or the amount of sludge available may not justify investment in suitable combustion plant or adaptation of existing plant.

Re-use of sludge as such, i.e. as opposed to re-use of raw materials recovered from sludge, in paper and related products has hitherto generally been considered impossible except in low grade moulded products such as egg cartons or in certain paperboard packaging products where the function rather than the appearance of the product is of primary importance. The presence of dirt, debris and contaminants as described earlier, and the colour of the sludge, particularly if derived wholly or in part from makings of coloured papers, preclude its use in higher quality papers where a good appearance is essential.

Previous proposals for recovery of re-usable papermaking raw materials from paper mill sludges have generally either aimed to recover just one type of raw material present, for example filler or fibre, or have sought to separate recovered material into distinct fractions. For example, U.S. Pat. No. 3,876,497 proposes wet air oxidation of paper mill waste sludges to remove fibre and other organic materials and leave re-usable inorganic filler. European Patent Application No. 442183A proposes cleaning paper mill waste solids to remove debris, followed by screening to separate long fibres from fibre fines and clay, and bleaching and washing the long fibres to provide re-usable pulp of the same quality as used originally. The fibre fines and clay are dewatered and disposed of as a sludge. German Patent No. 4034054C, of which there is a counterpart International patent Application No. WO 92/08001A, proposes screening of dilute waste sludges to remove coarse impurities, centrifuging to remove "black particles" and fine screening the thus-treated materials to bring about fractionation into a fibre portion, an agglomerate portion (fibre/filler agglomerate) and a filler and pigment portion.

The proposals described above have the drawback either of recovering only one of the re-usable raw material components present or of requiring complex centrifuging and screening equipment to separate raw material components which eventually are likely to be re-used in combination again.

Clearly it would be advantageous to have a process in which substantially all the papermaking raw materials present were re-used and which did not require separation of these raw materials prior to re-use. The present invention seeks to provide such a process suitable for use in the production of fine papers (i.e. high quality papers).

The idea of complete re-cycling or recovery of all papermaking raw materials is not in itself new. Thus British Patent No. 1482002 discloses a method for making paper with substantially complete closure of the white-water cycle. A major proportion of the white water is used in an untreated state for separation of pulp fibres ("stuff defibring") and dilution, whilst the remainder is treated with specified chemicals to produce clear water and a sludge. The clear water is re-used in the paper manufacturing process, while the sludge is added without further treatment to the stuff (papermaking stock) flowing into the headbox of the papermaking machine.

British Patent No. 1482002 is silent as to the type of papers which can be commercially produced using this process, but our experience and, we believe, that of the industry generally, is that re-use of sludge without some form of specific treatment is not practicable for commercial production of fine papers. This is consistent with the above-mentioned German Patent No. 4035054C, which states, in translation, that "sludge is highly contamixnated with dirt particles, thus precluding any re-use for quality papers. "

We have now discovered that sludge from fine paper production can be re-used in the manufacture of fine papers (when mixed with additional papermaking fibre) without an unacceptable deterioration in the quality of the finished product if a dispersion of the sludge is subjected to a preliminary screening/cleaning treatment at a relatively low consistency, thickened, heated and, crucially, passed through a disperser in the thickened heated state before being re-used in a papermaking operation.

Broadly therefore, the present invention resides in a process incorporating the steps just set out.

As will be clear from the foregoing, the use of a disperser is a key feature of the present invention. A disperser, also known as a disintegrator pump or as a disperger, is a type of radial-discharge centrifugal pump having teeth in the rotor shaft which mesh with teeth in the peripheral stator bars to provide a mechanical action on the liquid passing through the machine (see "Handbook of Pulp & Paper Terminology" by Gary A. Smook, published 1990 by Angus Wilde Publications of Vancouver, Canada). The teeth commonly have a so-called "devil's tooth" configuration to minimise fibre damage. Dispersers are commercially available from such companies as Cellwood Machinery AB of Nässjö, Sweden and Escher Wyss of Ravensburg, Germany.

The use of dispersers is well-known in the paper industry for use in de-inking processes for the treatment and recycling of waste paper. However, it had not previously been appreciated, prior to the present invention, that a disperser could afford benefits for paper mill sludge treatment when used with high consistency heated sludge dispersions. Treatment under conditions of high consistency and temperature is necessary if passage through the disperser is not to result in an undesirable degree of fibre damage. By high temperature is typically meant above about 100° C., preferably around 125° C.

The use of a disperser is also disclosed as an optional feature in the above-mentioned German patent No. 4034054C, but this proposal is dissimilar from the present invention. Firstly, German Patent No. 4034054C discloses use of a disperser, prior to hydrocyclone treatment of the sludge dispersion, for breaking down the normally flocculated structure of the dispersion, and/or for conducting a separated filler/pigment fraction to a flotation station—neither of these uses is analagous to that in the present process. Secondly, German Patent No. 4034054C stresses the importance of treatment of the sludge dispersion at a consistency of 1 to 5%, whereas the present invention requires passage through the disperser at a much higher consistency. Thirdly, German Patent No. 4034054C does not disclose high-temperature sludge treatment.

More particularly, the present invention provides a process for the recovery and re-use of raw materials from paper mill waste sludge, comprising the steps of:

a) screening and/or cleaning a dispersion of the sludge to remove large contaminants;

b) thickening and heating the resulting dispersion to a consistency of at least 10% by weight, preferably at least 20% by weight, more preferably 25 to 30% by weight and a temperature of at least about 100° C., more preferably to around 120° to 125° C.;

c) passing the thickened heated dispersion through a disperser effective to break up dirt and other debris; and d) re-using the resulting dispersion in a papermaking operation.

It is not normally feasible to make fine or other high quality papers solely from raw materials recovered by a process as just defined. Thus the recovered raw materials should be used in conjunction with papermaking fibre from at least one other source. This additional papermaking fibre can be mixed with the sludge prior to the treatment steps (a) to (c) above, and/or the sludge can be treated on its own, before being mixed with the additional papermaking fibre prior to step (d) above. The materials recovered from the sludge will normally constitute only a minor proportion of the final papermaking stock, with the additional papermaking fibre present in a major proportion.

The papermaking fibre with which the sludge is mixed prior to or after the recovery treatment can be fresh virgin pulp, mill broke (i.e. recycled waste from within the mill), pre-consumer broke (i.e. paper which has left the paper mill but has not reached the end-user, for example waste from a paper converting plant), or good quality waste paper (i.e. paper which has been used by a printer or other end-user, and which is referred to hereafter as post-consumer broke), or any combination of these. Additional filler may be added if necessary, although filler will be present in the sludge and in the various types of broke. For the purposes of this specification, any such additional filler should be included with the additional papermaking fibre when considering what are "minor" and "major" proportions, respectively, of sludge and papermaking fibre from another source. If virgin pulp is used, it is normally separately refined and only mixed with recovered sludge raw materials shortly before the papermaking operation.

Raw materials recovered from sludge generally make up not more than about 30% by weight of the solid material used in the final papermaking operation. The preferred proportion of raw materials recovered from sludge has so far been found to be around 10% to 20% by weight of the solid material used in the final papermaking operation (when making fine printing and writing papers).

Screening and/or cleaning of the sludge dispersion is preferably accomplished using a high density cyclone cleaner to remove a large dense contaminants such as grit, small pieces of metal, etc., followed by further treatment of the accepts by means of a high consistency rotating screen (typically with holes of about 2.5 mm diameter) to remove lightweight contaminants such as plastics particles. The rejects from both the cyclone cleaner and the rotating screen are then preferably further treated by means of a pressurized vibrating tailing screen. Accepts from this are recycled back to an earlier stage of the process, whilst the rejects are discarded, for example to landfill. It is important to note however that these landfill rejects are "contraries" or other contaminants, and that there is therefore negligible loss of papermaking raw materials in this way.

The consistency of the dispersion varies during the various screening and cleaning stages but is typically within the range 2% to 6% by weight.

Thickening of the dispersion is preferably accomplished using a series of screw thickeners, for example one or more screw dewaterers followed by one or more screw presses, effective to raise the consistency from an initial low value, typically around 4%, to a value of 20 to 30%, preferably around 25 to 30% by weight.

The thickened dispersion is then preferably passed through a plug screw effective to produce a seal and thereby a closed system. This is advantageous in order to reduce steam consumption. From the plug screw the fibre/sludge mixture is preferably fed to a so-called "fluffer" which transforms the compressed fibre sludge plug into "crumbs" (similar to Kollergang pulp) before it passes into the heating chamber. By fluffing up the fibre/sludge mixture in this way, quicker and more even heating is accomplished. Heating is conveniently by injection of superheated steam, preferably to a temperature of around 125° C., as stated previously.

An arrangement of thickeners, plug screw, fluffer, heating chamber and disperser as just described is known in itself for de-inking and treatment of waste paper, and is supplied as a proprietary system by Cellwood Machinery A.B., under the designation "Krima Dispersing System". So far as we are aware however, it had not prior to the present invention been proposed to use this system for the treatment of paper mill waste sludge, despite the fact that the system has been on the market for many years.

Bleach is normally added to improve the brightness of the final product, if desired, at any suitable stage of the process. In the preferred system just described, the bleach addition is at a point between the thickeners and the plug screw. FAS (formamidine sulphinic acid) is a suitable bleach.

Once the fibre/sludge mixture has emerged from the disperser after processing as described above and has been diluted, typically with white water, it is suitable for use in a conventional papermaking stock, normally when combined with additional papermaking fibre in one or more of the ways already described. This papermaking stock is used to make paper in the normal way. Particularly if the initial sludge is wholly or predominantly derived from fine papers production, the present process may be used to manufacture fine papers, which is a major advance in the art. However, the brightness of the pulp derived from the treated sludge is inevitably somewhat less than that of completely fresh pulp, even after bleaching, and so the present process is particularly suitable for producing coloured fine papers where brightness is not so important as for high white papers.

It will be appreciated that substantially all papermaking raw materials originally present in the sludge are also present in the final papermaking stock. Thus the process is virtually a "zero waste" process as far as papermaking raw materials are concerned (all discarded materials being contraries or contaminants). This too represents a major advance in the art so far as fine paper or other good quality paper production is concerned.

In order to enable the invention to be more readily understood, reference will now be made to the accompanying drawings, which illustrate diagrammatically and by way of example an embodiment thereof, and in which.

The process to be described relates to the treatment and re-use of sludge as produced in a paper mill manufacturing fine papers and containing papermaking fibre and filler in approximately equal proportion.

All percentages and proportions referred to are by weight.

Figure 1:
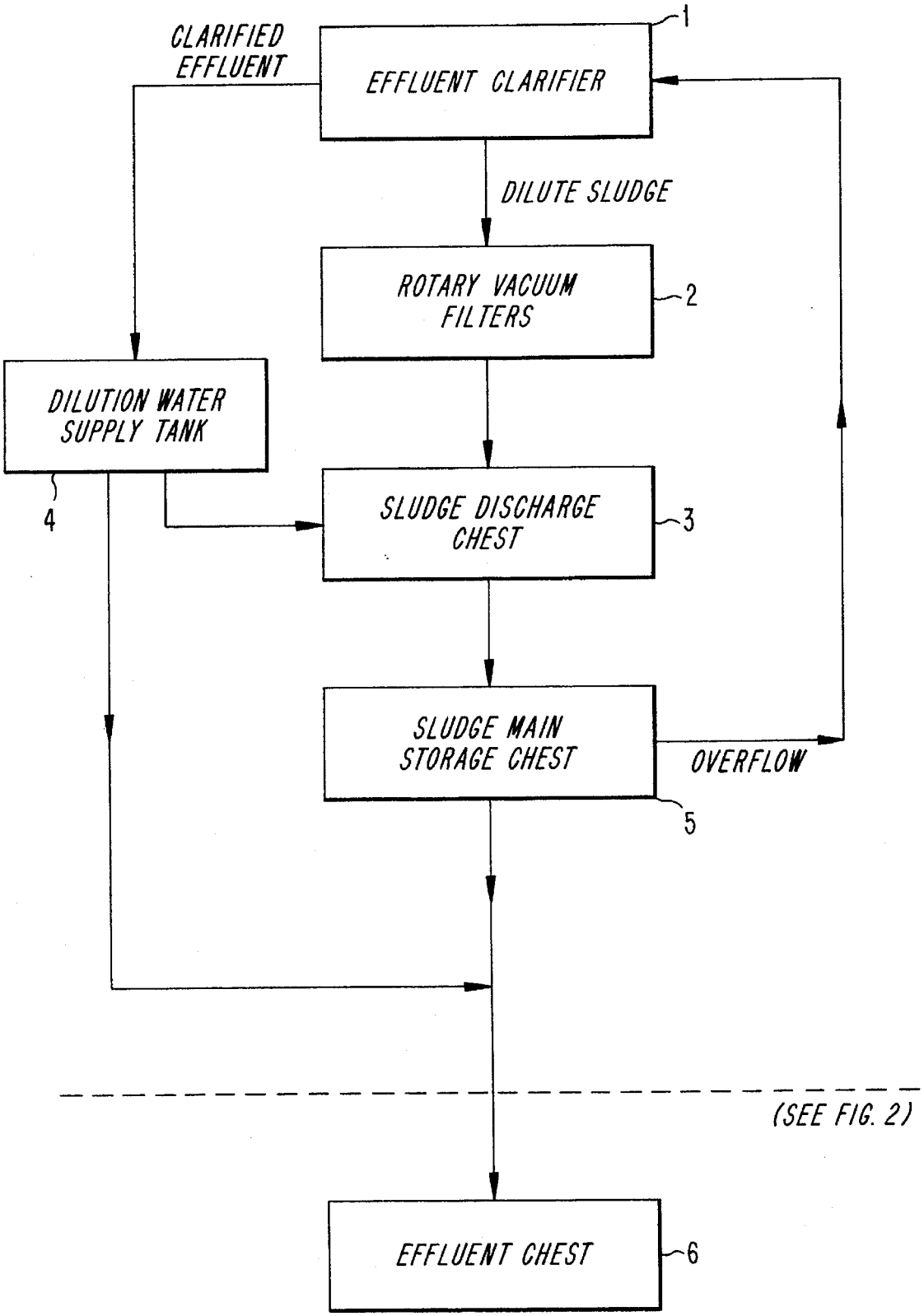
FIG. 1 is a simplified schematic block flow diagram of the sludge pre-treatment stage of the process.

Referring first to FIG. 1, sludge from the underflow of a conventional effluent clarifier 1 is pumped to a pair of rotary vacuum filters 2. These serve to dewater the sludge from an initial consistency of around 2.5% to a consistency of around 20 to 25%. The concentrated semi-solid sludge, now termed "crumble" falls into a conical chute (not shown), which discharges into a sludge discharge chest 3. Dilution water is supplied to the sludge discharge chest 3 from a dilution water supply tank 4 so as to dilute the crumble to about 6% consistency. This dilution water is the clarified effluent from the clarifier 1. A load cell (not shown) is fitted to the sludge discharge chest 3 to control the amount of dilution water added. The diluted sludge is then pumped from the sludge discharge chest 3 to a much larger sludge main storage chest 5. Any overflow from the storage chest 5 is returned to the clarifier 1.

Figure 2:
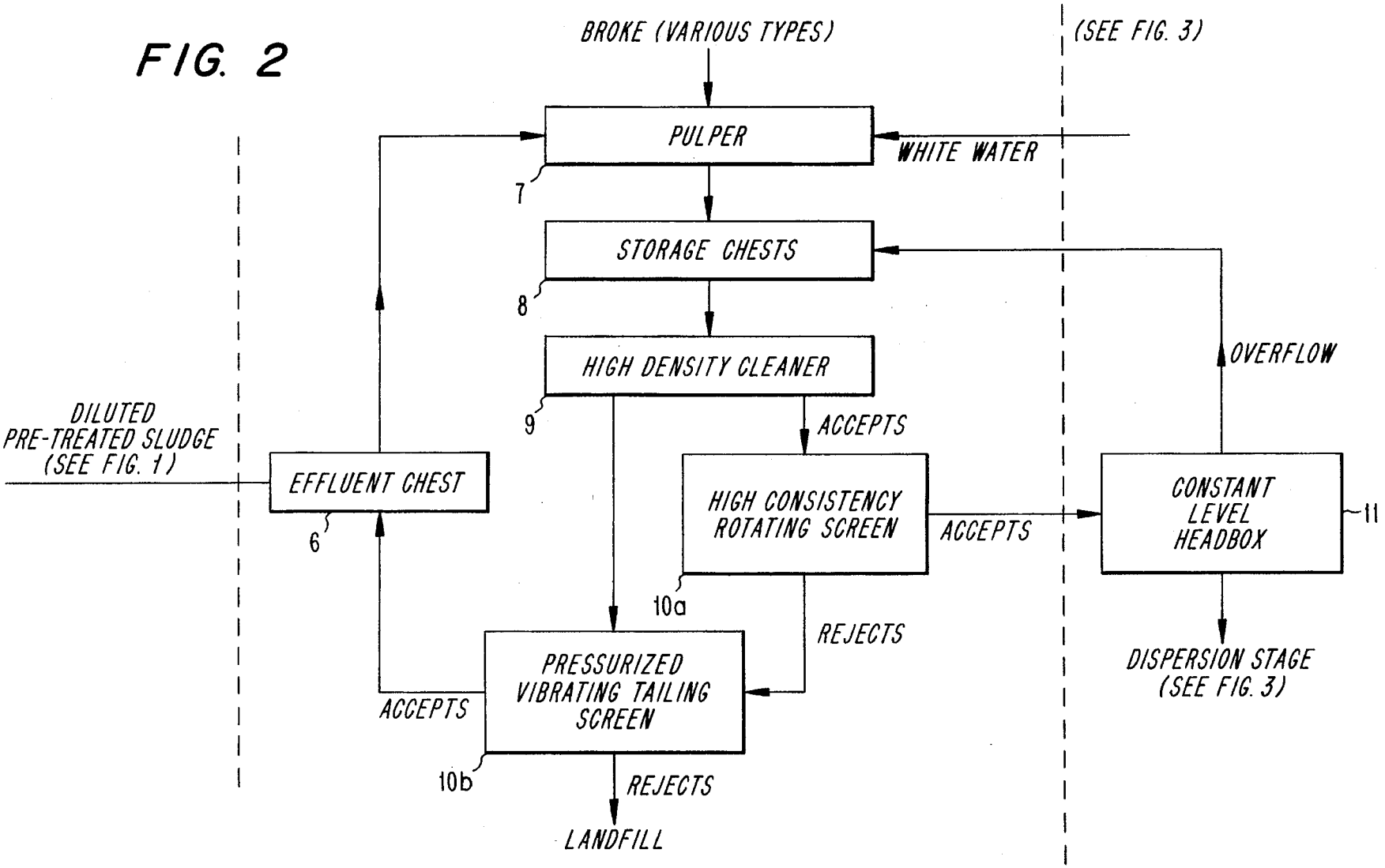
FIG. 2 is a simplified schematic block flow diagram showing the mixing of sludge with papermaking fibre from other raw materials and subsequent screening and cleaning.

Sludge from the chest 5 is pumped on demand to an effluent chest 6 forming part of the next stage of the process as shown in FIG. 2 (the effluent chest 6 is shown in both FIGS. 1 and 2 for convenient reference). Pumping of the sludge to the chest 6 is facilitated by first diluting to around 2% consistency with water from the supply tank 4.

Referring now to FIG. 2, the diluted sludge from the effluent chest 6 is pumped to a pulper 7. Various types of broke (as preciously described) are also added to the pulper, and the mixture is slushed at about 6% consistency. White water from the paper machine is used for dilution and slushing.

The proportion of sludge added does not normally exceed about 30%, and more typically is of the order of 10 to 20%. The proportions of pulp, pre- and post-consumer waste can vary widely, but pulp and pre-consumer waste normally predominate. Post-consumer waste can be omitted entirely (as of course can pre-consumer waste, but this is normally uneconomic). All the numerical values just quoted in relation to proportions are based on the total dry weight of solid material present.

After slushing, the resulting stock is pumped to storage chests 8. Stock is pumped on demand from these chests, initially to a high density cyclone cleaner 9. This removes large high density contaminants, as previously described. The accepts from the cyclone cleaner 9 pass to a high consistency rotating screen **10*a* with 2.5 mm diameter holes for removal of lightweight contaminants, particularly plastics contaminants. Rejects from both the cyclone cleaner 9 and the rotating screen 10*a* are fed to a pressurized vibrating tailing screen 10*b*. Accepts from the screen 10*b* are fed back to the effluent chest 6**, and the rejects are collected and disposed of, typically by landfill. These rejects contain no or only a negligible amount of papermaking raw material (i.e. papermaking fibre, filler and additives).

Figure 3:
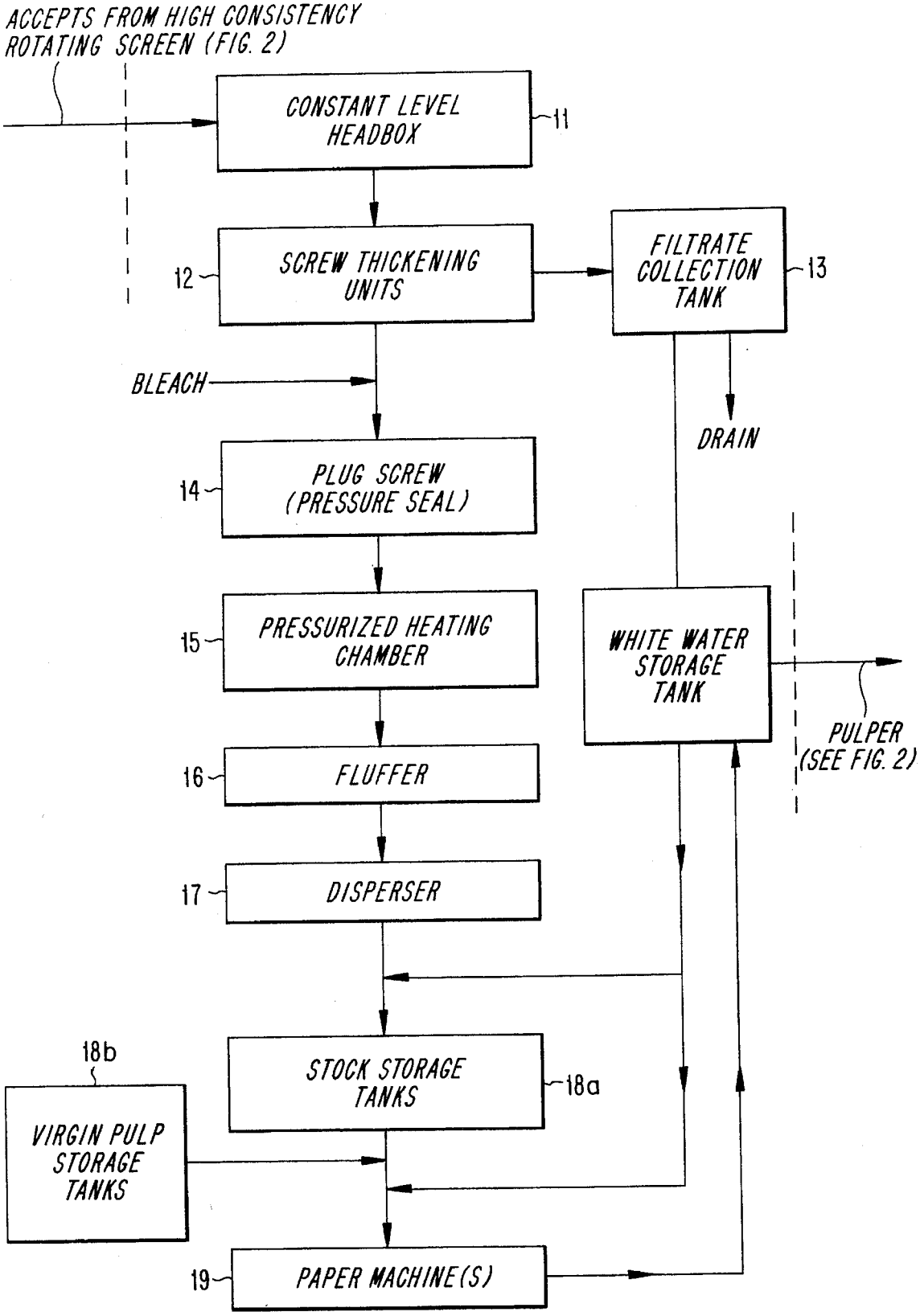
FIG. 3 is a simplified schematic block flow diagram showing the dispersion stage of the process.

The accepts from the rotating screen **10*a*, which are at a consistency of about 4%, are passed to a constant level headbox 11 which feeds the dispersing stage of the process (FIG. 3). This headbox 11 is shown on both FIGS. 2 and 3 for convenient reference. The overflow from the headbox 11 passes back to the storage chests 8**.

Referring now to FIG. 3, stock from the headbox 11 feeds a series of screw thickening units 12 which increase the stock consistency from its initial approximately 4% value to around 25 to 30%. Filtrate from these units is collected in a tank 13, and is either pumped to the whitewater storage tank 14 for dilution use or is pumped to drain. The thickening units 12 are screw thickeners and screw presses arranged in series.

The thickened stock is then passed into a plug screw 14 which forms a pressure seal. Bleach (preferably FAS) is normally injected into the stock just prior to the plug screw to increase the brightness of the final product. The plug screw conveys the stock into a screw-fed pressurized heating chamber 15 in which the stock temperature is raised by direct pressurized saturated steam injection to about 125° C. The heated stock then passes through a screw-fed fluffer 16 prior to its passage through the disperser 17. The disperser 17 is of conventional design, as discussed earlier in this specification. It serves to break down and finely divide dirt particles so that they are no longer visible to the naked eye, and hence are no longer a problem, except to the extent that they lower the brightness of the final product—this is compensated for by the bleach addition. The use of high stock consistency and temperature renders the pulp fibres flexible and thus not subject to serious damage in the dispersing process.

After dispersion, the stock is diluted back down to around 4% consistency with white water and is held in storage tanks **18*a* prior to use on the papermachine(s) 19, together with refined virgin pulp from virgin pulp storage tanks 18*b*. Excess backwater from the papermachine(s) is returned to the white water storage tank 14** in conventional manner.

The screw thickening units 12, the plug screw 14, the heating chamber 15, the fluffer 16 and disperser 17 together constitute a "Krima Dispersing System" as supplied for the recovery of raw materials from waste paper by Cellwood Machinery AB, of Nässjö, Sweden.

The invention will now be illustrated by the following Examples, which relate to a trial in which thickened sludge was treated before rather than after mixing with additional papermaking fibre as was described with reference to the drawings. All percentages are by weight.

150 kg of 60% moisture content sludge from the effluent plant of a paper mill making fine papers (and containing papermaking fibre and filler in approximately equal proportions) were slushed with approximately 16001 water in a pulper. After slushing, the mixture was passed through a Krima Dispersing System as referred to earlier. Specifically, the mixture was thickened to 30% consistency by means of a screw dewaterer followed by a screw press. The thickened material was then fluffed up and preheated to 120° C. in a separate screw-fed heating chamber by means of saturated superheated steam, after which it was passed through a Krima Disperser Type KF450.

FAS bleach was added prior to dispersing at a target level of 0.5% based on the total weight of solid material present.

The resulting treated fibre/filler mixture was dried and used as part of a 4% consistency furnish for the manufacture of a series of uncoated fine writing or printing papers. The furnish and paper details were as follows, the "sludge" referred to being the dried fibre/filler mixture recovered from the original waste sludge:

| Paper | Furnish | Grammage ($gm^{-2}$) | Colour |
|---|---|---|---|
| A | 10% sludge<br>25% linters<br>65% woodpulp | 100 | blue |
| B | 10% sludge<br>90% woodpulp | 90 | off-white |
| C | 20% sludge<br>20% waste paper*<br>60% mill broke | 100 | yellowish white |
| D | 10% sludge<br>65% mill broke<br>25% linters | 100 | grey |
| E | 10% sludge<br>90% woodpulp | 250 | grey-green |

*i.e. post-consumer waste

All the resulting papers were judged to be sufficiently free of dirt specks to be of saleable quality, although Papers A and E, which were particularly high quality products, were felt to require some hand sorting since they were somewhat dirtier than routine production. It was felt however that the requirement for hand sorting would either disappear as more experience was gained with the process, or could be avoided by the use of a smaller proportion of sludge.

I claim:

1. A process for recovery, and re-use in a papermaking operation, of fibrous and particulate filler raw materials from paper mill waste sludge, comprising the steps of:

screening/cleaning a dispersion of the paper mill waste sludge to remove large contaminants from the dispersion;

thickening and heating the dispersion having large contaminants removed therefrom to a thickened and heated state having a consistency of at least 10% by weight and a temperature of at least 100° C.;

passing the thickened and heated dispersion through a disperser effective to break up dirt and other debris; and using the resulting dispersion without separation of the fibrous and particulate filler prior to re-use as recovered raw materials in a papermaking operation.

2. The process as claimed in claim 1, wherein the recovered raw materials are used in conjunction with other solid materials which include papermaking fibre from at least one other source.

3. The process as claimed in claim 2, wherein the papermaking fibre from at least one other source is added before the thickening and heating step.

4. The process of claim 2, wherein the recovered raw materials are mixed with the other solid materials in the papermaking operation in a proportion of up to 30% by weight based on the weight of total solid material used in the papermaking operation wherein the total solid material includes the recovered materials and the other solid materials.

5. The process as claimed in claim 2, wherein the recovered raw materials in proportion to total solid material used in the papermaking operation is in the range of 10 to 20% by weight wherein the total solid material includes the recovered raw materials and the other solid materials.

6. The process as claimed in claim 1, wherein the thickening and heating step includes thickening the dispersion having large contaminants removed therefrom in a thickening operation followed by heating the thickened dispersion and wherein the consistency of the dispersion is raised in the thickening operation from an initial low consistency in the range of 2 to 6% by weight to a consistency in the range of 20 to 30% by weight.

7. The process as claimed in claim 1, wherein the thickened and heated dispersion has been heated to a temperature of around 120° to 125° C. by injection of superheated steam.

8. The process as claimed in claim 1, wherein the dispersion having large contaminants removed therefrom in the thickening and heating step is thickened by means of screw thickeners, passed through a plug screw and a fluffer into a heating chamber, heated by means of superheated steam, and then the thickened and heated dispersion is passed through the disperser.

9. The process as claimed in claim 1, wherein the paper mill waste sludge is derived from production of fine papers and the recovered raw materials are re-used in the production of fine papers.

10. The process as claimed in claim 1, wherein the thickening and heating step includes thickening the dispersion having large contaminants removed therefrom in a thickening operation followed by heating the thickened dispersion and wherein the consistency of the dispersion having large contaminants removed therefrom is raised in the thickening operation from an initial low consistency in the range of 2 to 6% by weight to a consistency in the range of 25 to 30% by weight.

11. A process for recovery, and re-use in a papermaking operation, of fibrous and particulate filler raw materials from paper mill waste sludge, without separation of the fibrous and particulate raw materials prior to re-use, said process comprising the steps of subjecting a dispersion of the paper mill waste sludge to a preliminary screening/cleaning treatment at a relatively low consistency, thickening and heating the screened/cleaned dispersion to a thickened heated state passing the thickened and heated dispersion through a disperser and using the resulting dispersion without separation of the fibrous and particulate filler raw materials prior to re-use as recovered raw materials in a papermaking operation.

12. The process as claimed in claim 11, wherein the recovered raw materials are used in conjunction with other solid materials which include papermaking fibre from at least one other source.

13. The process as claimed in claim 12, wherein the papermaking fibre from at least one other source is added before the thickening and heating step.

14. The process of claim 12, wherein the recovered raw materials are mixed with the other solid materials in the papermaking Operation in a proportion of up to 30% by weight based on the weight of total solid material used in the papermaking operation wherein the total solid material includes the recovered materials and the other solid materials.

15. The process of claim 12, wherein the recovered raw materials are mixed with the other solid materials in the papermaking operation in a proportion of 10 to 20% by weight based on the weight of total solid material used in the papermaking operation wherein the total solid material includes the recovered materials and the other solid materials.

16. The process as claimed in claim 12, wherein the thickening and heating step includes thickening the screened/cleaned dispersion in a thickening operation followed by heating the thickened dispersion and wherein the consistency of the screened/cleaned dispersion is raised in the thickening operation from an initial low consistency in the range of 2 to 6% by weight to a consistency in the range of 25 to 30% by weight.

17. The process as claimed in claim 11, wherein the thickening and heating step includes thickening the screened/cleaned dispersion in a thickening operation followed by heating the thickened dispersion and wherein the consistency of the screened/cleaned dispersion is raised in the thickening operation from an initial low consistency in the range of 2 to 6% by weight to a consistency in the range of 20 to 30% by weight.

18. The process as defined in claim 11, wherein the thickened and heated dispersion has been heated to a temperature of around 120° to 125° C. by injection of superheated steam.

19. The process as claimed in claim 11, wherein the screened/cleaned dispersion in the thickening and heating step is thickened by means of screw thickeners, passed through a plug screw and a fluffer into a heating chamber, heated by means of superheated steam, and then the thickened and heated dispersion is passed through the disperser.

20. A process as claimed in claim 11, wherein the paper mill waste sludge is derived from production of fine papers and the recovered raw materials are re-used in the production of fine papers.

* * * * *